United States Patent [19]

Bishai

[11] Patent Number: 4,966,410

[45] Date of Patent: Oct. 30, 1990

[54] PUMPING SYSTEM FOR THE BACK SUPPORT OF A SEAT

[75] Inventor: Macram N. Bishai, Windham, N.H.

[73] Assignee: McCord Winn Textron, Winchester, Mass.

[21] Appl. No.: 338,576

[22] Filed: Apr. 17, 1989

[51] Int. Cl.[5] ..... A97C 7/46

[52] U.S. Cl. ..... 297/284; 297/DIG. 3

[58] Field of Search ..... 297/284, DIG. 3

[56] References Cited

U.S. PATENT DOCUMENTS 4,114,214 9/1978 Von Heck ..... 297/284 X 4,707,027 11/1987 Horvath et al. ..... 297/284

4,792,186 12/1988 Benjamin et al. ..... 297/284

*Primary Examiner*—Gerald A. Michalsky

*Attorney, Agent, or Firm*—John P. Moran

[57] ABSTRACT

A high pressure pumping system for power inflating and power bleeding the lumbar support of a vehicular seat including a high pressure air cell mounted in the back support. A two-position pneumatic switch serves to selectively alternately reverse a motor and pump to inflate the air cell to a predetermined capacity 5 or greater p.s.i., and to manually deflate the air cell through a bleed valve until the system pressure is lower than the set pressure of a pressure cut-off switch whereupon the motor and pump power bleed the system.

3 Claims, 1 Drawing Sheet

PUMPING SYSTEM FOR THE BACK SUPPORT OF A SEAT

TECHNICAL FIELD

This invention relates generally to hand operated pumping systems for the back support of a seat, such as vehicle seats, and, more particularly, to such a system of a high pressure type.

BACKGROUND ART

Vehicle seats tend to become uncomfortable when the driver or passenger remains in a seated position for a long period of time. The primary area of discomfort is in the lumbar or lower back region.

Typically, while there are provisions for horizontal and tilting adjustments of vehicle seats, the selected contour of the typical seat for the average size occupant does not conform to all body shapes. Hence, it is desirable to provide means for adjusting the contour of the back support of the seat.

Various arrangements have been used satisfactorily in the past to control the pressure in back and/or seat portions of a vehicle seat. For example, see the Switch and Valve Assembly in Manning et al U.S. Pat. No. 4,633,763, wherein a push button and associated stem serve to partially open a normally closed valve to bleed off fluid under pressure from a lumbar area bladder when the push button is partially depressed, and to close a switch and actuate a pump to inflate the bladder when the push button is fully depressed.

Von Heck U.S. Pat. No. 4,114,214 includes a seat filled with expanded polystyrene micro-bearings and a switch actuated pump system which reverses to either pump up or pump down a seat cushion. A second switch is operated in conjunction with the pump reversing switch to control a solenoid valve.

Imaoka et al U.S. Pat. No. 4,722,550 discloses a pump up system which changes the hardness of the seat or back portions in response to outputs from detecting means for detecting running conditions of the motor vehicle.

Von Heck U.S. Pat. No. 3,608,961 illustrates and describes a seat cushion filled with a plurality of plastic beadlike material deformable from a generally spherical shape into a multifacet structure as a result of seat pressure control with a vacuum pump and a simple valve.

Vanderbilt et al U.S. Pat. No. 3,326,601 describes an inflatable seat back which is pumped up by a non reversible air pump and then vented to the atmosphere by virtue of the operator pushing against the seat.

Horvath et al U.S. Pat. No. 4,707,027 discloses a vehicle seat having a pneumatic lumbar selectively connected with a reversible pump via a solenoid valve. When it is desired to power down the air from the lumbar bladder, a switch is actuated to open the solenoid valve and simultaneously start the reversible motor in an opposite direction via a relay and a contact.

DISCLOSURE OF THE INVENTION

Accordingly, a general object of the invention is to provide an improved pumping system for the back support of a seat which may be powered up and powered down.

Another object of the invention is to provide an improved high pressure pumping system for powering an air cell mounted in a vehicle seat back support, which is simple in construction, can be manufactured at low cost, and is efficient in operation.

A further object of the invention is to provide a reversible high pressure pumping system for controlling a lumbar support in a vehicle seat, including a pneumatic switch for reversing a motor and pump to alternately inflate and deflate an air cell, with a pressure cut-off switch operating in conjunction with a bleed or exhaust valve.

These and other objects and advantages will be more apparent when reference is made to the following description and accompanying drawings.

BEST MODE OF CARRYING OUT THE INVENTION

Figure 1:
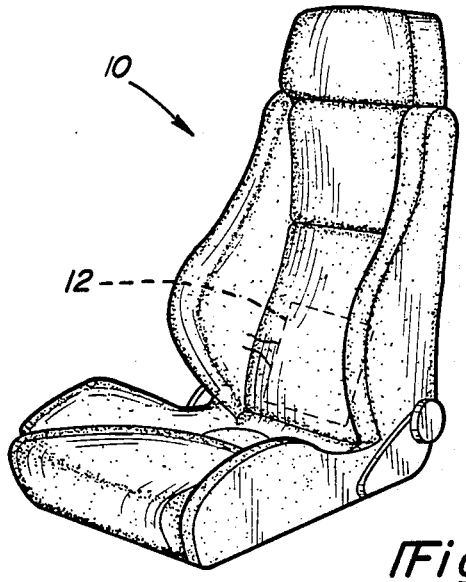
FIG. 1 is a perspective view of a vehicle seat embodying the invention.
Figure 2:
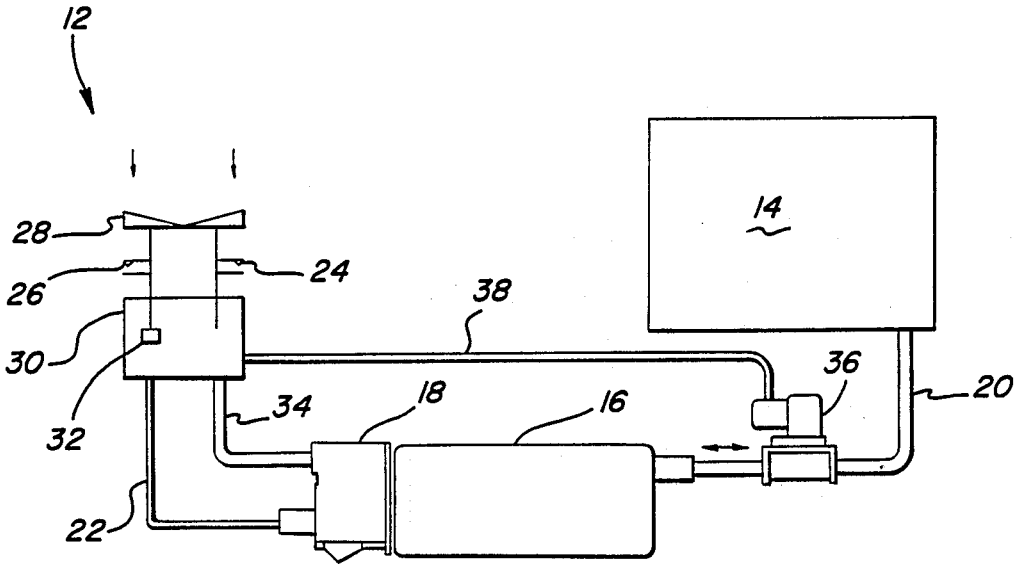
FIG. 2 is a diagramatic layout of the inventive pumping system embodied in the seat structure of FIG. 1.

Referring now to the drawings in greater detail, FIG. 1 illustrates an automotive single seat 10, having a high pressure pumping system 12 mounted therein for adjusting the back support of the seat.

The system 12 includes an air cell 14 having a capacity of 5 or greater p.s.i., a reversible pump 16 driven by a motor 18, and a conduit 20 communicating between the pump and the air cell. Reversing mode type lead lines 22 are operatively connected between the motor 18 and pairs of contacts 24 and 26 of a two-position pneumatic switch 28 in a switch housing 30.

A normally closed bleed or exhaust valve 32 is mounted in the switch housing 30, operably connected to the contacts 26. A conduit 34 communicates between the bleed valve 32 and the pump 16.

A pressure cut-off switch 36 is mounted in the conduit 20 and connected by lead lines 38 to the exhaust valve 32.

In operation, when the contacts 24 of the switch 28 are manually engaged, the motor 18 is actuated via the lead lines 22 to drive the pump 16 so as to pump air through the conduit 20 and the pressure cut-off switch 36 to inflate the air cell 14 to a predetermined set pressure of 5 or greater p.s.i., say, from 5 to 7 p.s.i. Once this pressure is attained, the pump stops and the system is sealed by the normally closed bleed valve 32.

When it is desired to deflate the air cell 14, the contacts 26 of the switch 28 are manually engaged. This opens the bleed valve 32 and serves to manually bleed the system through the conduits 20 and 34 until the system pressure is lower than the set pressure of the cut-off switch 36. Once a pressure lower than the set pressure is reached, the contacts 26 reverse the polarity across the motor 18 to drive the pump 16 in the reverse direction. This power serves to bleed the system through the conduits 20 and 34 and the bleed valve 32. There is no need for a solenoid or relays in the system.

INDUSTRIAL APPLICABILITY

It should be apparent that the invention provides a compact and efficient high pressure pumping arrangement having a minimum number of system components for inflating and deflating an air cell mounted in the lumbar region of a seat, such as a vehicle seat, for maximum riding comfort and desired support.

While but one embodiment of the invention has been shown and described, other modifications are possible within the scope of the following claims.

The embodiments of the invention in which an exclusive property or privilege is claimed are defined as follows:

1. A high pressure system for power inflating and power bleeding the back support of a seat, and system comprising a predetermined high pressure air cell mounted in said back support, a combination electric motor and reversible pump, a two-position switch with two alternately operative pairs of contacts, a normally closed bleed valve, a first conduit communicating between said air cell and said pump, a second conduit communicating between said pump and said bleed valve, and a pressure cutoff switch operatively mounted in said first conduit, said switch adapted in one position to actuate said motor and pump-in one direction to fill said air cell via said first conduit, and in the other position to open said normally closed bleed valve and initially manually bleed said air cell and to reverse said motor and pump to power bleed said air cell once the system pressure becomes lower than the set pressure of said pressure cut-off switch.

2. The high pressure system described in claim 1, wherein said predetermined high pressure is a minimum of p.s.i.

3. The high pressure system described in claim 1, wherein said predetermined high pressure is in the range of 5 to 7 p.s.i.

* * * * *